US005871037A

United States Patent [19]

Feldt

[11] Patent Number: 5,871,037

[45] Date of Patent: Feb. 16, 1999

[54] COLLAPSIBLE BAG FILLER FOR ASSISTING IN THE FILLING OF WASTE BAGS

[76] Inventor: Richard W. Feldt, 3110 D Patty Ln., Middleton, Wis. 53562

[21] Appl. No.: 960,009

[22] Filed: Oct. 29, 1997

[51] Int. Cl.[6] ..... B65B 1/04

[52] U.S. Cl. ..... 141/391; 141/314; 141/316; 141/337; 141/390

[58] Field of Search ..... 141/390, 391, 141/337, 316, 313, 314, 252, 263; 193/15, 30, 2 A

[56] References Cited

U.S. PATENT DOCUMENTS

| | | | |
|---|---|---|---|
| 176,555 | 4/1876 | Scholfield | 141/390 X |
| 177,729 | 5/1876 | Loring | 193/2 A |
| 182,173 | 9/1876 | Cussen | 141/390 |
| 205,361 | 6/1878 | Cussen | 141/316 |
| 221,442 | 11/1879 | Broome | 193/2 A |
| D. 243,158 | 1/1977 | Bolwell . | |
| D. 307,755 | 5/1990 | Rhodes et al. . | |
| 435,638 | 9/1890 | Barnes | 141/390 X |
| 726,685 | 4/1903 | Holbrook | 193/30 |
| 733,247 | 7/1903 | Mitchell | 141/314 X |
| 954,161 | 4/1910 | Best | 141/337 |
| 1,660,442 | 2/1928 | Hampton | 141/337 X |
| 3,915,329 | 10/1975 | Zaks | 141/390 |
| 4,014,157 | 3/1977 | Pearce | 141/390 X |
| 4,020,922 | 5/1977 | Klasel | 141/314 X |
| 4,133,356 | 1/1979 | Dillingham | 141/316 |
| 4,248,278 | 2/1981 | Blodgett . | |
| 4,485,855 | 12/1984 | Dillingham | 141/316 |
| 5,048,778 | 9/1991 | Wright . | |
| 5,673,779 | 10/1997 | Spickelmire | 193/30 X |
| 5,765,614 | 6/1998 | Kardosh | 141/390 |

FOREIGN PATENT DOCUMENTS

| | | | |
|---|---|---|---|
| 404021907 A | 1/1992 | Japan | 193/2 A |

*Primary Examiner*—David J. Walczak
*Assistant Examiner*—Kathleen J. Prunner
*Attorney, Agent, or Firm*—DeWitt Ross & Stevens S.C.

[57] ABSTRACT

A bag filler which is particularly suited for filling of yard waste bags. The bag filler has a top funnel with a descending collapsible loading nozzle. The loading nozzle is inserted within a waste bag and waste is loaded into the funnel to channel it into the bag. The wide inlet of the funnel increases the effective mouth area of the bag, making the bag easier to fill. The loading nozzle is preferably configured to allow it to be selectively locked into various lengths between fully extended and fully collapsed lengths. The length of the loading nozzle can thus be configured to fit bags of varying depths. Bag-retaining structure may be provided on the funnel and/or loading nozzle to allow attachment of a bag rim about the bag filler so that a bag is held in an open state with the nozzle resting therein.

20 Claims, 4 Drawing Sheets

COLLAPSIBLE BAG FILLER FOR ASSISTING IN THE FILLING OF WASTE BAGS

FIELD OF THE INVENTION

This disclosure concerns an invention relating generally to apparata for assisting in the filling of bags, and more specifically to bag-filling funnels for assisting in the filling of garbage or yard waste bags.

BACKGROUND OF THE INVENTION

Homeowners and others who tend to lawns and gardens often need to gather waste such as leaves, weeds, branches, and other plant matter for disposal in garbage bags. Such garbage bags, which typically have a 20–40 gallon capacity, are generally made of thin and flexible but durable plastic and are provided in the form of folded or rolled sheets which may be unfolded into baglike form. Many communities are now requiring that special types of garbage bags be used for disposal of yard and other organic waste. Such bags are often made of highly biodegradable plastic, and/or are specially colored for tallying by sanitation workers who may limit the number of bags that can be disposed within a given time period, or who may levy per-bag charges for disposal of yard waste.

Difficulty is often encountered when filling the aforementioned garbage bags during yard work. Initially, the garbage bags are not rigid, and thus the bag rim surrounding the bag mouth tends to sag downwardly during filling unless it is supported by a user. However, when the user is gathering waste to place in the bag, the user generally does not have hands free to maintain the sides of the bag in an upright position. Further, garbage bags, and particularly the aforementioned "special" yard waste bags, often suffer from the disadvantage that they are not appropriately sized for convenient use: the bag mouths can be so narrow that it is difficult for the user to insert a large mass of leaves, weeds, or other voluminous waste into the bag, particularly when both hands are needed to hold and insert such matter.

SUMMARY OF THE INVENTION

This disclosure concerns a bag filler which is intended to solve the aforementioned problems, and additionally which offers numerous new and advantageous features for making bagging of yard and other waste far easier. The bag filler, which is defined by the claims set out at the end of this disclosure, will now be summarized with reference to its particularly preferred embodiments. Initially, the invention is directed to a bag filler having a funnel tapering from a broad top funnel inlet to a narrow bottom funnel exit, and having a funnel passage defined therebetween. A loading nozzle descends from the funnel exit and terminates in a nozzle exit, and includes a nozzle passage extending therebetween. The funnel passage and nozzle passage together define an elongated waste passage whereby waste loaded into the funnel inlet will be directed to fall through the bag filler and out its nozzle exit, and thereby into a bag wherein the loading nozzle extends. The funnel inlet is generally intended to be greater in size than the mouth of the bag with which the bag filler will be used, and therefore the funnel inlet effectively enlarges the bag mouth to channel waste into the bag and enhance the ease of bag filling.

The loading nozzle is preferably selectively collapsible and expansible so that the nozzle passage has variable length. This is preferably done by providing the loading nozzle with multiple telescopically sectioned nozzle sections wherein some or all of the nozzle sections receive adjacent nozzle sections within their interiors to effect the collapsibility. Collapsibility allows the bag filler to be reduced in size for easier storage. Additionally, collapsibility allows the length of the loading nozzle to be adapted to accommodate varying bag depths. As an example, the loading nozzle can be set in collapsed or erect form within a bag and upon the ground, and with the funnel resting outside the bag so that the funnel can be accessed for filling purposes. Waste can be loaded into the loading nozzle and funnel until they are full. The bag can then be lifted erect about the loading nozzle, and the bag filler can be lifted from the bag to leave it partially filled or full. If at this time the bag is only partially filled, the loading nozzle can be set within the bag in collapsed or erect form with the nozzle exit resting atop the waste previously loaded into the bag, and further waste can then be loaded into the funnel (and thus into the bag). This filling process can be repeated until the bag is full.

A collapsible loading nozzle can be particularly advantageous where the bag filler incorporates bag retaining means for holding a bag about the loading nozzle. In this case, the loading nozzle of the bag filler may be placed on the bottom of a bag, and may then be set erect in expanded form so that a bag is held upright with the loading nozzle standing therein. Waste can be loaded into the funnel to fill the bag in the manner noted above. Both of the user's hands are free to fill the funnel with waste since the user need not hold the rim of the bag in position around the loading nozzle.

Where the loading nozzle is made of multiple sections which telescopically collapse, the bag filler preferably also incorporates locking means for allowing the various nozzle sections to selectively lock into place with respect to adjacent nozzle sections. This allows selected nozzle sections to be releasably locked in collapsed relation to each other, or alternatively in extended relation to each other. Such a locking means may take the form of a threaded engagement between adjacent nozzle sections; tabs on one nozzle section which releasably engage depressions situated on other nozzle sections; tabs on one nozzle section which ride within slots defined in other nozzle sections; or other structures extending between nozzle sections and restraining them from relative motion, e.g., pins. By incorporating these or other locking means, the user need not lift the funnel of the bag filler to place the loading nozzle in an extended state, since the loading nozzle will remain in that condition once it is so set.

Additionally, the nozzle passage of the loading nozzle preferably expands in cross-sectional area from the funnel exit to the nozzle exit. Where the loading nozzle is collapsible and telescopically sectioned, as described above, this nozzle expansion can be achieved by having each nozzle section be slightly greater in cross-sectional area than the higher adjacent nozzle section, so that each nozzle section receives the higher adjacent nozzle sections within its interior when the loading nozzle is collapsed. An expanding nozzle passage helps to reduce the possibility that waste will become wedges in the nozzle passage during use.

As noted above, the bag filler may include bag retaining means situated beneath the funnel inlet for retaining a bag about the loading nozzle. Such a bag retaining means, which is preferably provided on the loading nozzle adjacent the funnel exit, may be provided by tongues or other protrusions extending from the bag filler upon which the rim of the bag may be wrapped or impaled. A bag retaining means is extremely advantageous on the bag filler when provided in combination with the aforementioned locking means, since in this case the loading nozzle may be set onto the bottom of a bag which is held by the retaining means, and may then be fully extended and locked into place by the locking means. This arrangement will automatically hold a bag in an upright, fully open, ready-to-fill state.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
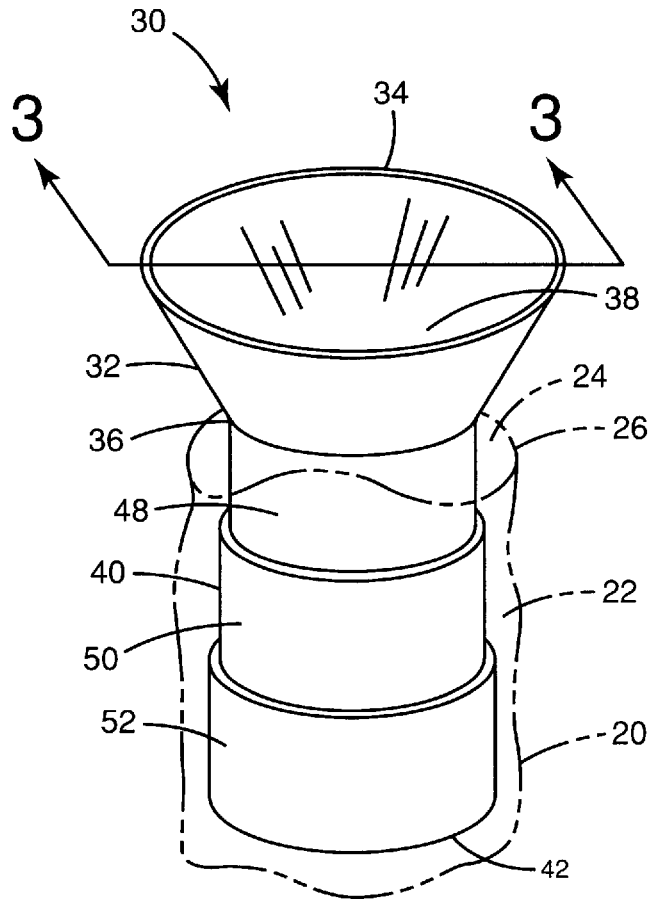
FIG. 1 is a perspective view of a first embodiment of the bag filler shown in an extended state.

In the drawings, wherein the same or similar features of the invention are designated in all Figures with the same reference numerals, FIG. 1 illustrates a first embodiment of the bag filler invention at the reference number 30. A standard bag 20 is also shown in phantom in FIG. 1 to better illustrate the general mode of use of the bag filler 30, with the bag 20 including sidewalls 22 terminating in a bag rim 26 surrounded by a bag mouth 24.

The bag filler 30 includes a funnel 32 having a broad top funnel inlet 34 which is preferably broader than the bag mouth 24, and a narrow bottom funnel exit 36. The funnel 32 therefore defines a converging funnel passage 38 between the funnel inlet 34 and the funnel exit 36 for channeling waste received at the funnel inlet 34 into a more concentrated and compact form at the funnel exit 36.

A loading nozzle 40 then descends from the funnel exit 36 to terminate in a nozzle exit 42. Within the interior of the loading nozzle 40, a nozzle passage 44 (shown in FIG. 3) connects the funnel passage 38 to the nozzle exit 42, and thus the funnel passage 38 and nozzle passage 44 together define a waste passage 46 extending through the length of the bag filler 30. Waste compacted at the funnel exit 36 is thus channeled through the nozzle passage 44 to the nozzle exit 42.

The loading nozzle 40 is collapsible and includes several telescopically sectioned nozzle sections, in this case an uppermost nozzle section 48, a middle nozzle section 50, and a lowermost nozzle section 52. Each nozzle section closely and slidably fits into the interior of any lower nozzle section when the bag filler 30 (or more specifically the loading nozzle 40) is in its collapsed state, as illustrated in FIG. 2.

Figure 2:
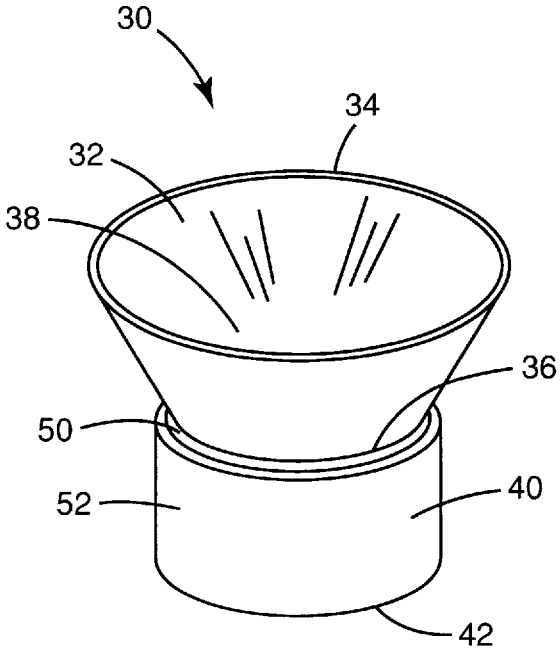
FIG. 2 is a perspective view of the bag filler of FIG. 1 shown in a collapsed state.
Figure 3:
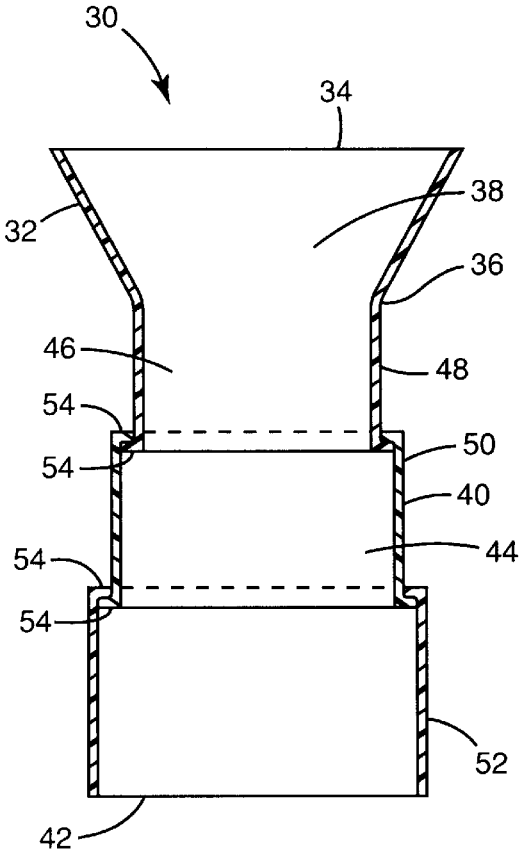
FIG. 3 is a side cutaway view of the bag filler shown from the lines 3—3 of FIG. 1.

It is notable that FIGS. 1–3 illustrate telescopically collapsing nozzle sections wherein the cross-sectional areas of the interiors of the nozzle sections increase from the funnel exit 36 to the nozzle exit 42 (i.e., each nozzle section has a uniform interior cross-sectional area which is somewhat larger than the interior cross-sectional area of any prior nozzle sections). This arrangement is particularly preferred because it provides for an expanding nozzle passage 44 throughout the length of the loading nozzle 40, thereby reducing the possibility of waste clogging the nozzle passage 44. Waste falling through the loading nozzle 40 encounters no outwardly-protruding discontinuities within the nozzle passage 44 as it falls, and is therefore unlikely to catch on the interior walls of the nozzle sections.

As illustrated in FIG. 3, each nozzle section may include limiting means for preventing disengagement with other nozzle sections during extension of the loading nozzle 40. FIG. 3 illustrates a particular form of limiting means provided by engaging lips 54 formed on the tops and/or bottoms of the nozzle sections 48, 50, and 52. The lips 54 on each nozzle section engage the lips 54 on adjacent nozzle sections during extension and prevent the nozzle sections from coming apart.

The bag filler 30 is preferably dimensioned to be approximately 42 inches high when extended and approximately 20 inches high when collapsed, with the top 6 inches being occupied by the funnel 32 and each nozzle section being approximately 14 inches high when standing alone. The narrowest portion of the waste passage 46 (that being the portion of the nozzle passage 44 within the uppermost nozzle section 48) is preferably approximately 24 inches in diameter, with the funnel inlet 34 being approximately 36 inches in diameter. All portions of the bag filler 30 are preferably made of durable weather-resistant plastic, though other materials could be used instead.

To place the bag filler 30 in use, the collapsed bag filler 30 (as shown in FIG. 2) is placed within the bag mouth 24, and the bag rim 26 and the funnel 32 are simultaneously lifted upwardly. The weight of the loading nozzle 40 holds the bottom of the bag 20 down as the bag rim 26 is lifted. If the user desires, the bag rim 26 could be temporarily retained about the loading nozzle 40 by taping it to the funnel 32 and/or the uppermost nozzle section 48. The user can then insert waste into the funnel inlet 34, either while holding the funnel 32 and bag 20 up so that the bag filler 30 is in its extended state, or after allowing the bag filler 30 to collapse and the bag to droop. If the funnel 32 and bag 20 are held up so that the bag filler 30 remains in its extended state, the bag 20 is simply filled via the filling of the bag filler 30. Otherwise, if the bag filler 30 is set down on the ground in collapsed form within the bag 20, the user can begin filling the collapsed bag filler 30. In this case, as the loading nozzle 40 and funnel 32 begin to fill, the user can occasionally lift the funnel 32 (and thus the loading nozzle 40) to extend the loading nozzle 40 and settle the waste. As the waste fills each nozzle section, the waste will tend to prevent higher nozzle sections from collapsing downwardly into lower nozzle sections. Therefore, the process of sequentially filling the collapsed bag filler 30, extending it, and then allowing it to collapse will generally result in the gradual upward extension of the loading nozzle 40 as it fills. When the loading nozzle 40 is filled with waste (and is thus substantially or fully extended), the bag rim 26 may be lifted up so that the bag surrounds the entirety of the loading nozzle 40. The bag filler 30 may then be pulled from the bag 20 to leave the waste within the bag 20. Because the nozzle passage 44 expands in the downward direction, the weight of the waste within the extended loading nozzle 40 does not hinder removal of the loading nozzle 40, and it is an easy matter to pull the bag filler 30 from the bag to leave the waste therein. If desired, the collapsed bag filler 30 may then be placed atop the waste already resting within the bag 20, and the filling process can be repeated until the entirety of the bag 20 is filled.

Figure 4:
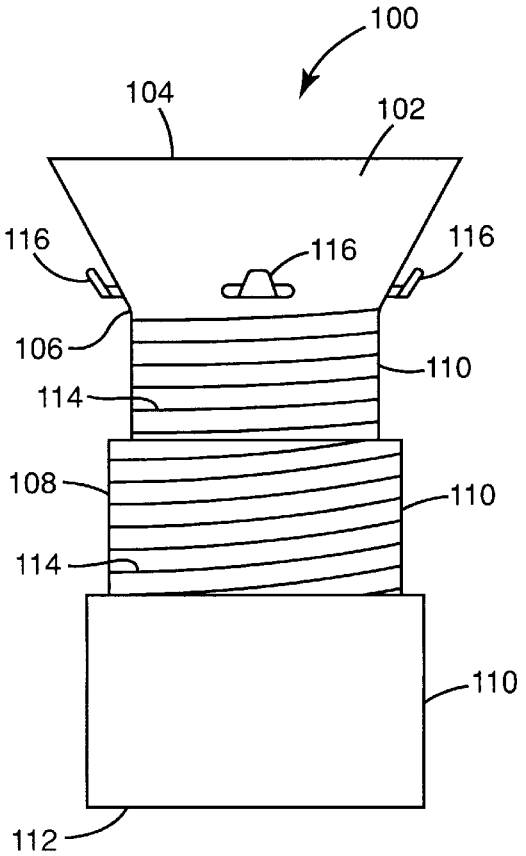
FIG. 4 is a side view of a second embodiment of the bag filler.

FIGS. 4–7 then illustrate other embodiments of the invention offering additional features for enhanced convenience. In FIG. 4, the bag filler 100 includes a funnel 102 having a broad top funnel inlet 104 and a narrow bottom funnel exit 106, and additionally a collapsible loading nozzle 108 having multiple nozzle sections 110 situated between the funnel exit 106 and a nozzle exit 112, with a nozzle passage (not shown) being formed therebetween. Again, the nozzle sections 110 are formed to be telescopically collapsible with the nozzle passage expanding in cross-sectional area nearer the nozzle exit 112. The bag filler 100 has two significant features which were not illustrated or described above for the basic bag filler 30.

First, the nozzle sections 110 include locking means for releasably affixing each nozzle section 110 to at least one other nozzle section 110, thereby allowing a user to extend and/or collapse the nozzle sections 110 and have them remain affixed in that state until the user desires otherwise. In the bag filler 100, the locking means takes the form of complementary threading 114 formed on the adjacent interiors and exteriors of some of the nozzle sections 110. Thus, a user may screw one or more nozzle sections 110 together to collapse the loading nozzle 108, or may thread the nozzle sections 110 apart to extend the loading nozzle 108.

Second, the bag filler 100 also includes a bag retaining means situated beneath the funnel inlet 104 for retaining a bag about the loading nozzle 108. In FIG. 4, the bag retaining means is provided in the form of upwardly-directed prongs 116 upon which a bag rim may be hooked or impaled, thereby automatically maintaining the bag in an open state surrounding the loading nozzle 108 regardless of whether it is collapsed or extended.

Figure 5:
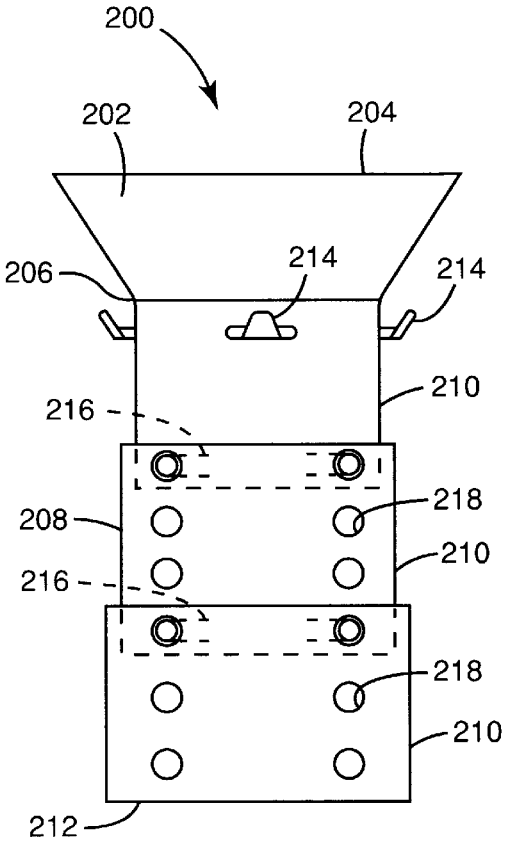
FIG. 5 is a side view of a third embodiment of the bag filler.
Figure 6:
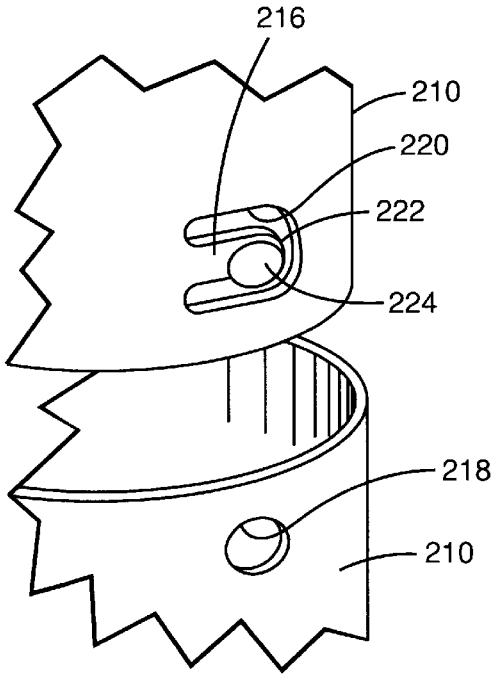
FIG. 6 is a perspective view of a portion of the bag filler of FIG. 5, illustrating portions of two nozzle sections and the tab-and-aperture locking means used to lock these nozzle sections together when one nozzle section is interfit within the other nozzle section.

FIG. 5 illustrates a bag filler 200 which also includes a funnel 202 having a funnel inlet 204 broader than the funnel exit 206, and also including a loading nozzle 208 including collapsible nozzle sections 210 leading to a nozzle exit 212. Prongs 214 for retaining a bag about the loading nozzle 208 are illustrated. However, the bag filler 200 illustrates a form of locking means different from that of the bag filler 100 described above. In the bag filler 200, the locking means is provided by tabs 216 on some nozzle sections 210 which releasably engage complementary apertures 218 on adjacent nozzle sections 210. A preferable arrangement is illustrated in greater detail in FIG. 6, wherein a tab 216 is formed by defining a surrounding U-shaped slot 220 in a nozzle section to thereby define a free-floating tab end 222 on the tab 216. A button 224 can be formed on the tab end 222 for complementary reception within one of the apertures 218. Provided the nozzle sections 210 are formed of resiliently flexible material, the tabs 216 and their associated buttons 224 will flex inwardly when sliding within the interior of a nozzle section 210, and the buttons 224 will pop outwardly into apertures 218 when they are properly aligned with the apertures 218. To disengage the tabs 216 from the apertures 218, the user can press the buttons 224 inwardly to disengage them, thereby allowing the nozzle sections 210 in question to be collapsed or extended with respect to each other. As illustrated particularly by FIG. 5, it is contemplated that the nozzle sections 210 may include multiple tabs 216 and/or apertures 218 for allowing the nozzle sections 210 to be collapsed or extended in discrete length increments to various lengths as the user so desires. It is notable that the tabs 216 can also be depressed while continuously extending the loading nozzle 208 until the nozzle sections 210 disengage, allowing the nozzle sections 210 to be separated for easier cleaning.

Figure 7:
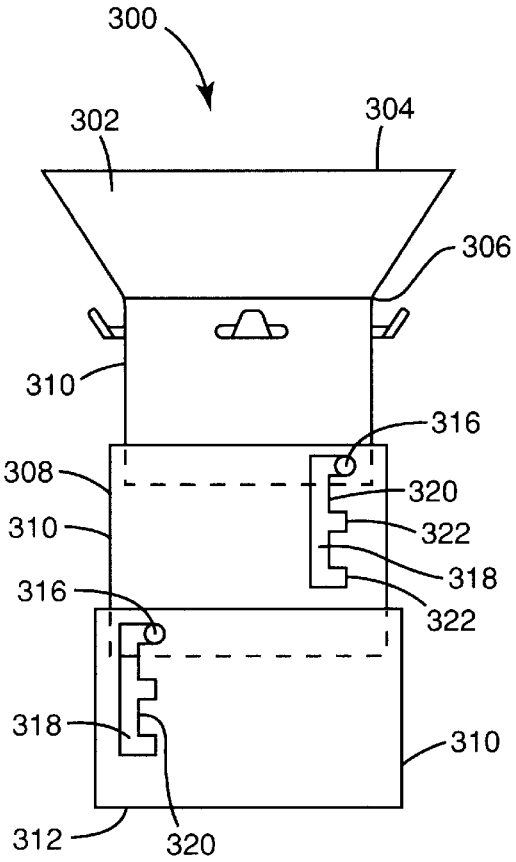
FIG. 7 is a side view of a fourth embodiment of the bag filler.

FIG. 7 then illustrates a bag filler 300 including a funnel 302 having a funnel inlet 304 broader than the funnel exit 306, and also including a loading nozzle 308 including collapsible nozzle sections 310 leading to a nozzle exit 312. The locking means provided by bag filler 300 include tabs 316 which ride in slots 318 defined in adjacent nozzle sections 310. These slots 318 preferably include a sliding slot section 320 which is oriented generally parallel to the length of the loading nozzle 308, and a retaining slot section 322 oriented generally perpendicular to the sliding slot section 320. The tabs 316 may slide within the sliding slot section 320 to position adjacent nozzle sections 310 at the fully collapsed and fully extended positions, and also at a variety of positions therebetween. Alternatively, the tabs 316 can be placed within retaining slot sections 322 to prevent the nozzle sections 310 from extending or collapsing within each other.

Figure 8:
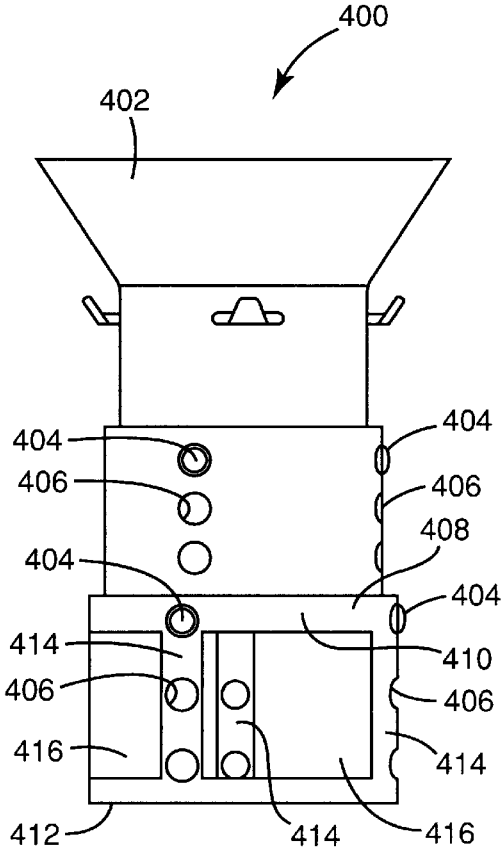
FIG. 8 is a side view of a fifth embodiment of the bag filler.

In the embodiments discussed above, the loading nozzle serves to support the funnel and/or bag, and to carry waste to the nozzle exit where the waste may be emptied. Waste empties into the bag solely from the nozzle exit at the lowermost end of the loading nozzle. In some circumstances, this may not allow filling of bags as quickly as a user may desire. A potential solution is illustrated in FIG. 8, which illustrates a bag filler 400 which is somewhat similar to the bag filler 200 of FIG. 5. The bag filler 400 includes a loading nozzle 402 having a locking means provided by vertically-oriented rows of tabs 404 and apertures 406 (with only the apertures 406 being partially visible for one of these rows because these apertures are located on the obscured reverse side of the bag filler 400). A lowermost nozzle section 408 has portions cut away so that the nozzle section 408 is basically defined by an inlet ring 410, an exit ring 412, and struts 414 extending therebetween, with supplementary nozzle exits 416 defined between the struts. In this manner, the lowermost nozzle section 408 forms a frame capable of supporting the extended bag filler 400 and also partially supporting the walls of a bag, and waste falling through the bag filler 400 will be able to escape its loading nozzle 402 through the supplementary nozzle exits 416 and more rapidly fill the bag. If desired, the exit ring 412 could be eliminated to further increase the size of the supplementary nozzle exits 416, but the leg-like struts 414 then have an increased likelihood of puncturing thinner bags. Alternatively or additionally, other nozzle sections (or at least several of the lower ones) could be similarly fashioned with supplementary nozzle exits to further enhance rapid filling of bags.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, the locking means for releasably locking the nozzle sections in place with respect to adjacent nozzle sections can take other forms apart from those described above. As an example, the lips 54 described above as limiting means and shown in FIG. 3 can be modified so that protruding structure on the lip of one nozzle section snap-engages a complementarily-fitting aperture on the lip of the adjacent nozzle section. Thus, when adjacent nozzle sections are fully extended (or collapsed) with respect to each other so that their lips are brought together, these nozzle sections will be releasably engaged in the fully extended state. As another example, the tabs 316 of the bag filler 300 (FIG. 7) can be configured to engage the slots 318 at any point along the length of the slots 318, as by defining each tab 316 by a threaded post extending through its slot 318 and also by a nut which may be screwed onto the post to bear against the nozzle section 310 wherein the slot 318 is defined. It should thus be understood that the locking means broadly encompasses both locking means which locks nozzle sections together after they are collapsed or extended at discrete length intervals, and also locking means which locks nozzle sections together at any point along a continuous range of extension/collapse.

Second, the bag retaining means for retaining bags about the loading nozzle may take a variety of forms apart from those noted above, such as spring-loaded clamps or other clips having opposable grippers; sleeves, cords, springs or other elongated structure encircling all or a portion of the bag filler and allowing insertion and retention of all or portions of the bag rim between said elongated structure and the bag filler; structures such as plugs or caps which may removably engage complimentarily-shaped structures on the bag filler, and which retain the bag if the bag is inserted between the plugs/caps and their receiving structure; and bag retaining means known to the art. The bag retaining means is also considered to encompass a funnel which is removable from the loading nozzle via threading, snap-fit structures, or other connections, and which allows the bag rim to be sandwiched between the funnel and loading nozzle during their reattachment to thereby retain the bag.

Third, other limiting means for preventing disengagement of adjacent nozzle sections may be provided apart from the lips 54 illustrated in FIG. 3 in conjunction with the bag filler 30. Adjacent nozzle sections can have their tops and bottoms so sized and configured so that the top of one nozzle section cannot disengage from the bottom of another. Otherwise, it is notable that the locking means noted above (e.g., the threading 114 of bag filler 100, the tabs 216 and apertures 218 of bag filler 200, the tabs 316 and slots 318 of bag filler 300, and the tabs 404 and apertures 406 of the bag filler 400) also serve as a limiting means in that they prevent disengagement of adjacent nozzle sections.

Fourth, the funnels and nozzles of the bag fillers need not have a round cross-sectional area, and could instead have polygonal or other cross-sections. Additionally, the nozzle sections need not have uniform cross-sectional areas throughout their lengths, and the nozzles sections could (for example) continuously expand in cross-sectional area from their inlets to their exits.

Fifth, while the various bag fillers illustrated in the Figures show telescopically collapsing nozzle sections, the telescopic arrangement is merely preferred and is not the only form of collapsibility that may be provided. As an example, every other nozzle section could be formed with the same interior cross-sectional area, and these could then slidably receive therein nozzle sections formed with a suitable exterior cross-sectional area. Further, collapsibility can also be provided by loading nozzles which are constructed without rigid nozzle sections. As a first example, a tubular cloth loading nozzle (preferably with a weighted ring at the nozzle exit) can be manually collapsed along its length, or can be made automatically collapsible by incorporation of elastic material along the length of the loading nozzle. As a second example, a loading nozzle may be formed of elongated lengths of flat flexible plastic sheeting which are placed face-to-face and which are joined at opposite edges of their widths to define an elongated flat sleeve with expansible cross-sectional interior area. Since this loading nozzle will ordinarily be in flat form unless waste passes through its interior and causes it to expand to a non-flat form, the plastic sheeting can be formed so that the nozzle rolls up along its length when it is not being filled and is not otherwise subjected to an unrolling force. As a third example, a loading nozzle could be formed of a flexible plastic tube including a series of accordion-folded annular sections situated along at least a portion of its length.

Sixth, it should be understood that while the various embodiments of the bag fillers are shown and described above with three nozzle sections, it is well within the scope of the invention to use more or less nozzle sections.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A bag filler comprising:

a. a funnel having a broad top funnel inlet and a narrow bottom funnel exit, b. a collapsible loading nozzle descending from the funnel exit and terminating in a nozzle exit, wherein an elongated waste passage is defined through the funnel inlet, funnel exit, and nozzle exit, and c. a bag having a bag rim opening onto a bag interior, the bag interior terminating in a bag bottom situated generally opposite the bag rim, wherein the bag rim is removably affixed to the funnel beneath the funnel inlet.

2. The bag filler of claim 1 wherein the collapsible loading nozzle includes at least two adjacently-situated nozzle sections, each of which is movable with respect to at least one of its adjacent nozzle sections.

3. The bag filler of claim 2 wherein each nozzle section has an interior which, during collapsing of the loading nozzle, receives therein any adjacent nozzle section located nearer the funnel exit.

4. The bag filler of claim 2 wherein each nozzle section is in threaded engagement with any adjacent nozzle section located nearer the funnel exit.

5. The bag filler of claim 2 wherein the nozzle sections include:

a. at least one slotted nozzle section including one or more slots defined therein, and b. at least one tabbed nozzle section including one or more tabs thereon, wherein the tabs ride within the slots during collapsing of the loading nozzle.

6. The bag filler of claim 5 wherein said at least one slotted nozzle section is also a tabbed nozzle section.

7. The bag filler of claim 5 wherein the slots include a sliding slot section oriented generally parallel to the length of the waste passage and a retaining slot section oriented generally perpendicular to the sliding slot section.

8. The bag filler of claim 2 wherein at least some nozzle sections include tabs thereon, and further wherein at least some nozzle sections include apertures defined therein wherein the tabs may be situated.

9. The bag filler of claim 8 wherein at least some of the tabs are actuatable to move in and out of the apertures.

10. The bag filler of claim 1 wherein the collapsible loading nozzle is segmented into multiple nozzle sections having interiors which define the waste passage within these nozzle sections, wherein the interiors of at least some of the nozzle sections receive adjacent nozzle sections when the loading nozzle is collapsed.

11. The bag filler of claim 10 wherein the nozzle sections are telescopically collapsible, and wherein the cross-sectional area of the interior of each nozzle section is greater than the cross-sectional area of any adjacent nozzle section located nearer to the funnel exit, whereby the cross-sectional area of the waste passage increases from the funnel exit to the nozzle exit.

12. The bag filler of claim 1 further comprising bag retaining means on the bag filler beneath the funnel inlet for retaining a bag about the nozzle.

13. The bag filler of claim 12 wherein the bag retaining means is situated on the loading nozzle adjacent the funnel exit.

14. The bag filler of claim 12 wherein the bag retaining means includes at least one protrusion extending from the bag filler whereupon a bag may be hooked.

15. The bag filler of claim 1 wherein the funnel inlet has a greater size than the bag rim.

16. The bag filler of claim 15 wherein the loading nozzle extends into the bag interior with the nozzle exit resting closer to the bag bottom than to the bag rim.

17. A bag filler comprising:

a. a funnel having a broad top funnel inlet and a narrow bottom funnel exit, wherein a funnel passage is defined between the funnel inlet and funnel exit;

b. a loading nozzle descending from the funnel exit and terminating in a nozzle exit, the loading nozzle having an enlarging nozzle passage defined between the funnel exit and nozzle exit, wherein the funnel passage and nozzle passage define an elongated waste passage, and c. a bag having a bag rim opening onto a bag interior, the bag interior terminating in a bag bottom situated generally opposite the bag rim, wherein the bag rim is removably affixed to the funnel beneath the funnel inlet.

18. The bag filler of claim 17 wherein the loading nozzle is collapsible and includes a series of rigid, generally coaxial nozzle sections.

19. The bag filler of claim 18 wherein the nozzle sections telescopically receive each other when the loading nozzle is collapsed.

20. The bag filler of claim 19 wherein the nozzle sections include locking means for releasably affixing each nozzle section to at least one other nozzle section.

* * * * *